US008769827B2

(12) United States Patent
Powers et al.

(10) Patent No.: US 8,769,827 B2
(45) Date of Patent: Jul. 8, 2014

(54) CHISEL BLADE WITH SIDES CONFIGURED FOR CUTTING

(75) Inventors: Russell Powers, Newington, CT (US); Karl Vanderbeek, West Hartford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 510 days.

(21) Appl. No.: 13/084,020

(22) Filed: Apr. 11, 2011

(65) Prior Publication Data

US 2012/0255180 A1 Oct. 11, 2012

(51) Int. Cl.
*B25D 3/00* (2006.01)

(52) U.S. Cl.
USPC ..... 30/167; 30/168

(58) Field of Classification Search
CPC ..... B25D 3/00; B25D 17/02; B25D 17/08; B25D 2250/111; B25D 2222/75
USPC ..... 30/167, 167.1, 167.2, 168, 169, 172, 30/352, 353, 355; D8/47; 125/41
See application file for complete search history.

(56) References Cited

U.S. PATENT DOCUMENTS

| | | | | |
|---|---|---|---|---|
| D34,139 | S | 2/1901 | Swan | |
| 952,744 | A | 3/1910 | Johnson | |
| 2,083,123 | A * | 6/1937 | Quick | 30/167 |
| 2,392,495 | A * | 1/1946 | Nameth | 30/92.5 |
| 2,735,179 | A | 2/1956 | Stanton | |
| 2,910,771 | A * | 11/1959 | Farmer | 30/168 |
| 4,089,562 | A * | 5/1978 | Baumeister | 299/100 |
| D346,103 | S | 4/1994 | Warner | |
| 5,692,308 | A * | 12/1997 | Di Libero | 30/353 |
| 5,979,058 | A | 11/1999 | Henke | |
| 7,257,896 | B2 * | 8/2007 | Kurtz | 30/167 |

(Continued)

FOREIGN PATENT DOCUMENTS

| | | |
|---|---|---|
| AU | 4823085 | 3/1986 |
| DE | 8800658 | 3/1988 |

(Continued)

OTHER PUBLICATIONS

Bahco SB-2448 Heavy Duty Wrecking Chisel Knife 10mm, Transtools [online], [retrieved Apr. 11, 2011]. Retrieved from the Internet <URL: http://www.transtools.co.uk/store/prod_11000/construction-tools/brick-bolsters-and-chisels/bahco-sb-2448-heavy-duty-wrecking-chisel-knife-10mm.html>.

(Continued)

*Primary Examiner* — Hwei C Payer
(74) *Attorney, Agent, or Firm* — Pillsbury Winthrop Shaw Pittman LLP

(57) ABSTRACT

A chisel includes a blade joined with a handle configured to be struck by a striking instrument. The blade includes a front beveled cutting edge portion at its forward end, a beveled side cutting edge portion along one longitudinal side of the blade, and a strike surface along an opposite, longitudinal side. The blade also has a main body portion that narrows in thickness as it extends in a forward direction from a relatively rearward portion thereof to the front beveled cutting edge portion and that narrows in thickness as it extends in a lateral direction from the strike surface towards the beveled side cutting edge portion. The beveled side cutting edge portion has a surface forms an angle with a surface of the main body portion.

57 Claims, 3 Drawing Sheets

(56) References Cited

U.S. PATENT DOCUMENTS

| | | | | |
|---|---|---|---|---|
| 7,269,867 | B2 | 9/2007 | Karlstedt | |
| D562,517 | S * | 2/2008 | Henke et al. | D32/46 |
| 7,363,922 | B2 * | 4/2008 | Lang et al. | 125/41 |
| 2006/0196056 | A1 | 9/2006 | Davis | |
| 2008/0189957 | A1 | 8/2008 | Kasper | |
| 2009/0199962 | A1 | 8/2009 | Legostaev, Jr. | |
| 2009/0320299 | A1 * | 12/2009 | Kuhn et al. | 30/169 |

FOREIGN PATENT DOCUMENTS

| | | |
|---|---|---|
| DE | 298 03 487 | 4/1998 |
| DE | 298 03 487 U1 | 4/1998 |
| DE | 299 12 541 U1 | 12/1999 |
| DE | 202007011182 | 12/2008 |
| EP | 1 340 595 | 9/2003 |
| EP | 2 511 051 A1 * | 10/2012 |
| GB | 19715 | 8/1914 |
| GB | 510151 | 7/1939 |
| GB | 2 006 663 | 5/1979 |
| RU | 2397256 | 8/2010 |
| TW | 200831230 | 8/2008 |
| WO | WO 03/08155 | 1/2003 |

OTHER PUBLICATIONS

Extended Search Report, including the Search Opinion, as issued for European Patent Application No. 12163793.8, dated Jul. 24, 2012.

* cited by examiner

CHISEL BLADE WITH SIDES CONFIGURED FOR CUTTING

BACKGROUND

1. Field

The present invention is generally related to chisels. More particularly, the application relates to chisels having an improved cutting blade.

2. Description of Related Art

Chisels typically include a blade with a sharp cutting edge and a handle. The handle has an end adapted to be struck by another tool, such as a hammer so that the sharp cutting edge can be used for carving, shaving, or cutting work pieces. In some chisels, a direction and/or angle for using the chisel can be limited to a position of the cutting edge and/or the location of the struck end relative to the striking edge.

SUMMARY

One embodiment comprises a chisel having: a handle with a back end of the handle configured to be struck by a striking instrument; and an elongated blade joined with the handle. The blade includes a main body portion, a front beveled cutting edge portion at a forward end thereof, a beveled side cutting edge portion along a first longitudinal side of the blade, and a strike surface along a second longitudinal side of the blade opposite the first longitudinal side. The main body portion that narrows in thickness as it extends in a forward direction from a relatively rearward portion thereof towards the front beveled cutting edge portion, and that narrows in thickness as it extends in a lateral direction from the strike surface towards the beveled side cutting edge portion. The beveled side cutting edge portion has a surface that forms an angle with a surface of the main body portion.

Aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein can be considered drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

DETAILED DESCRIPTION

Figure 1:
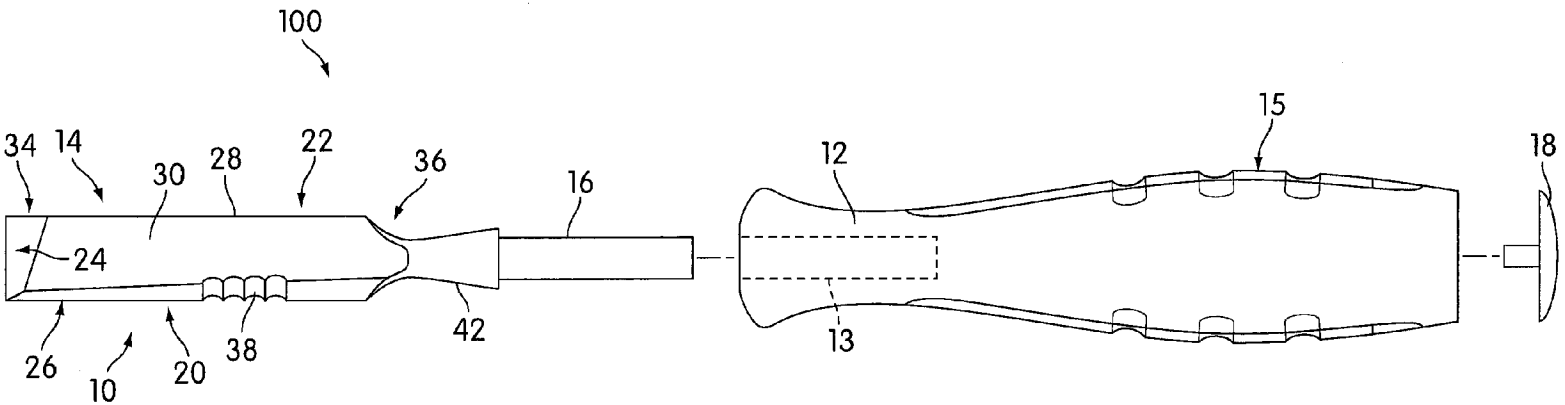
FIG. 1 shows an exploded top view of a chisel in accordance with an embodiment of the present invention.
Figure 2:
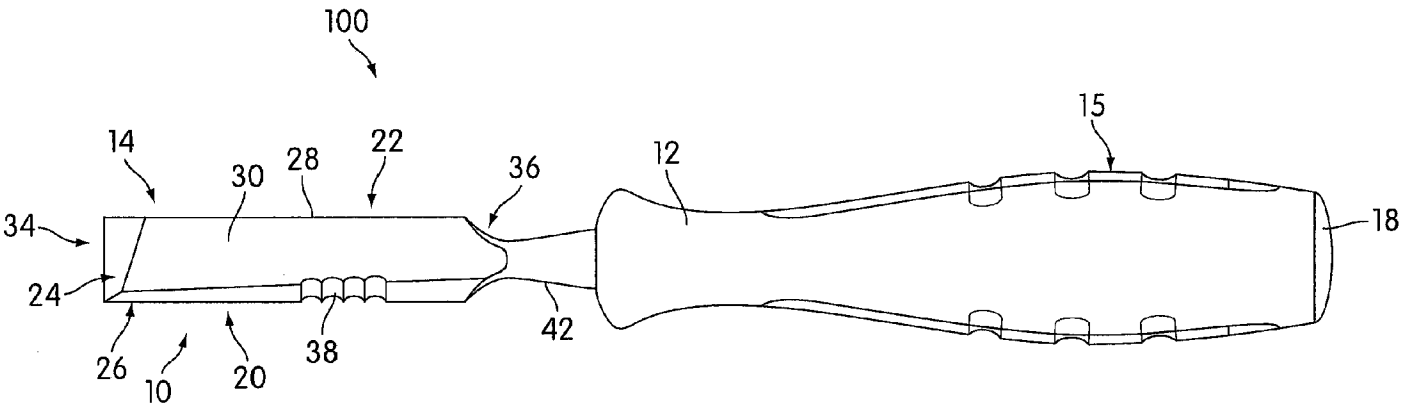
FIG. 2 shows a top view of the chisel of FIG. 1 with the handle portion and blade portion connected.

Referring now more particularly to the drawings, FIG. 1 is an exploded perspective view and FIG. 2 is an assembled perspective view of a chisel 100 in accordance with one embodiment of the invention. The chisel 100 includes a blade 10 and a handle 12 that are connected to one another. Handle 12 comprises an opening 13 for receiving shank portion 16 of chisel blade 10. In an alternate embodiment, handle 12 may be molded around shank portion 16. In an embodiment, handle 12 may also comprise an end cap 18 on its back end configured for being struck by another tool or striking instrument, such as a hammer. Handle 12 and end cap 18 are made of materials known to withstand impact. For example, handle 12 may be made of a polymer, and end cap 18 may be made of steel. Handle 12 may be contoured, shock absorbent, ergonomic, or other type of handle. In some embodiments, the handle 12 is made of metal, wood, a composite material, or a synthetic material. Handle 12 includes a manually engageable grip portion 15. In some embodiments, the grip portion 15 of the handle 12 may be made of a separate material or the same integral material as the main body of handle 12. The grip portion 15 may be made of an elastomeric material, a rubber based material, a plastic based material or other suitable material. Optionally, the grip portion 15 can be ergonomically shaped. For example, a plurality of arcuate indentations may be spaced longitudinally along a surface of the grip portion.

Chisel blade 10 comprises an elongate main body portion 14 that is connected with a shank portion 16. The main body portion 14 and shank portion 16 may be joined to each other or integrally formed together. The joining of the shank portion 16 and handle 12 form a hand-held chisel 100 that may be used to carve, shave, or cut work pieces made of wood, for example. In one embodiment, the handle 12 and shank may both be formed from the same material (such as steel), and may also be integrally formed.

Figure 3:
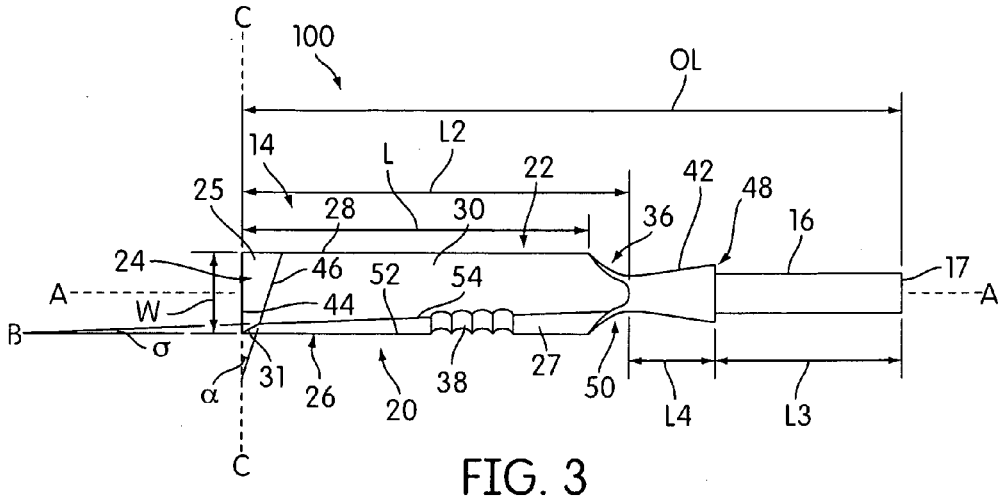
FIG. 3 shows a top view of the of the chisel blade of FIG. 1, illustrating angled edges of the cutting edge portion.
Figure 5:
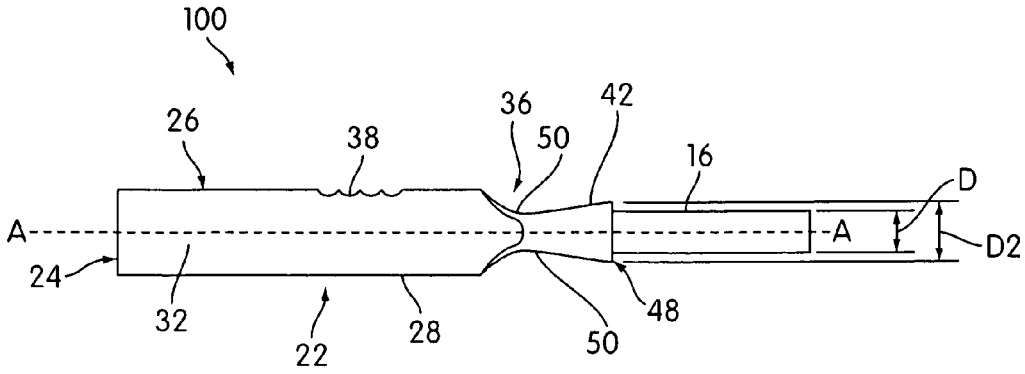
FIG. 5 shows a bottom view of the chisel blade of FIG. 1.

In an embodiment, the chisel blade 10 includes a neck portion 42 that connects the main body portion 14 with the shank portion 16. Neck portion 42 may comprise a gradual slope formed by a reduction in its diameter D2 from shank portion 16 towards body portion 14 (e.g., see FIG. 5). Transition areas 48 and 50 may be formed at a juncture of shank portion 16 and neck portion 42, and neck portion 42 and main body portion 14, respectively, as indicated in FIG. 3. Each transition area 48 and 50 may be formed adjacent the corresponding juncture, for example. Transitions areas 48 and 50 may be formed on a side (e.g., top and/or bottom side) of the juncture, and/or about a circumference of the juncture.

Chisel blade 10 includes an overall length dimension OL. As shown in FIG. 3, the overall length dimension OL of the chisel blade 10 is measured along (or relative to) a central longitudinal axis A-A of the blade 10. The overall length dimension OL is measured from the bottom-most end surface 17 of the shank portion 16 to a top most end of the blade 10, i.e., a front-most cutting edge 44 of leading cutting edge portion 24, as shown. In one non-limiting embodiment, the overall length dimension OL is between about 7 inches and about 10 inches.

Chisel blade 10 has an overall width W, which also corresponds to a width of leading cutting edge portion 24. Overall width W is measured perpendicular to central longitudinal axis A-A from a first elongate side 20 on one longitudinal side of the blade 10 to a second, opposite elongate side 22 along another longitudinal side of the blade 10, as shown in FIG. 3. In a non-limiting embodiment, the width W is between about 0.75 inches and about 1.5 inches. In one embodiment, the width W is about 1.0±0.1 inches.

Main body portion 14 comprises a length L2 measured from top most portion of the blade 10 (i.e., front most cutting edge 44 of front beveled cutting edge portion 24, described further below) to transition area 50 at neck portion 42. In an embodiment, length L2 of the main body portion 14 is between about 4.0 and about 5.0 inches. In another embodiment, length L2 of the main body portion 14 is less than 4.0 inches. In another embodiment, length L2 of the main body portion 14 is greater than 5.0 inches.

Shank portion 16 comprises a length L3, measured from a bottom most surface 17 of chisel blade 10 to neck portion 42. In an embodiment, length L3 of shank portion 16 corresponds to a length of opening 13 in handle 12, for example. In an embodiment, length L3 of shank portion 16 is about 2.0 to about 3.0 inches. In another embodiment, length L3 of shank portion 16 is less than 2.0 inches. In yet another embodiment, length L3 of shank portion 16 is about 2.25±0.1 inches. Shank portion 16 may also comprise a dimension that corresponds to a size or width of the opening 13 in the handle 12 for receiving shank portion 16 therein. In an embodiment, shank portion 16 comprises a diameter D. In an embodiment, diameter D is between about 0.4 to about 0.6 inches.

Neck portion 42 comprises a length L4 measured from about transition area 48 at the juncture with shank portion 16 to about transition area 50 at the juncture with main body portion 14. In an embodiment, length L4 of neck portion 42 is between about 0.5 and about 1.5 inches. In another embodiment, length L4 of neck portion 42 is between about 0.8 to about 1.0 inches. Also, as previously noted, neck portion 42 may comprise a gradual slope which may be formed by a reduction in its diameter D2 from shank portion 16 towards main body portion 14.

Referring now more specifically to working features of the chisel blade 10 shown in FIG. 3, elongate main body portion 14 has a first elongate side 20, a second, opposite elongate side 22, a top surface 30, a bottom surface 32, a front portion 34, and back portion 36. The blade 10 also comprises at least one longitudinally extending beveled side cutting edge portion 26 and an opposite longitudinal striking surface 28 or edge. In the illustrated non-limiting embodiment, the beveled side cutting edge portion 26 is provided substantially along an entire length of the first elongate side 20 of the body portion 14, and the striking surface 28 is provided on the opposite, second elongate side 22. As will become further evident in the description below, the striking surface 28 on second elongate side 22 provides a surface for impact with a tool (e.g., hammer, mallet) so that beveled side cutting edge portion 26 can be used to chisel materials at an angle with respect to the longitudinal direction of the chisel.

Back portion 36 includes the transition area 50 between the neck portion 42 to the main body portion 14. As better shown in FIGS. 4 and 5, bottom surface 32 may be substantially flat or planar between a top most part (near front beveled cutting edge portion 24) and transition area 50. That is, bottom surface 32 of the chisel blade is provided along plane P that is substantially parallel to central longitudinal axis A-A.

Figure 4:
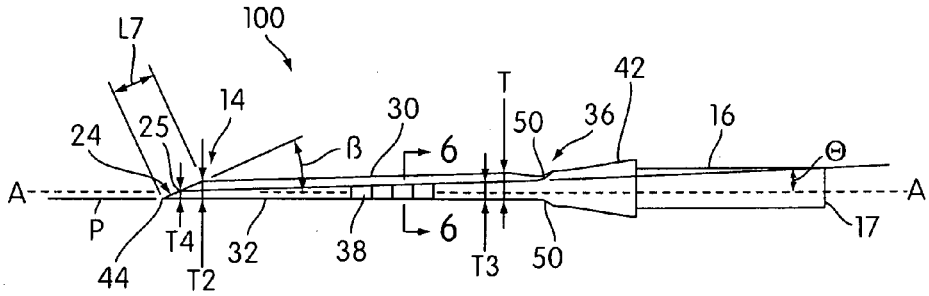
FIG. 4 shows a side view of the chisel blade of FIG. 1.

As seen in FIGS. 3 and 4, the front portion 34 of chisel blade 10 comprises a beveled cutting edge portion 24 that defines the leading surface areas of the blade. Front beveled cutting edge portion 24 may be used to chip, chop, chisel, or cut material. For example, when end cap 18 of handle 12 receives an impact (e.g., from a hammer), force is transmitted through the handle 12 and main body portion 14 to the front beveled cutting edge portion 24. A top view of the chisel blade 10 as shown in FIG. 3 shows that front beveled cutting edge portion 24 comprises a front-most cutting edge 44 and a back edge 46. An angled surface 25 extends from the back edge 46 to the front cutting edge 44 of front beveled cutting edge portion 24. The angled surface 25 extends at an angle with respect to the top surface 30. The angled surface 25 (which is the surface that can be sharpened to increase the sharpness of front edge 44) commences at its back edge 46, which may be contiguous with (and defines a forward edge of) the top surface 30, and slopes downwardly toward the bottom surface 32 as it extends in a forward direction towards the front-most cutting edge 44 of front beveled cutting edge portion 24. In one embodiment, angled surface 25 intersects and forms an angle with top surface 30 of the main body portion 14. In one embodiment, it is contemplated that the beveled cutting edge portion 24 can comprise a double bevel (where there is more than one angled surface).

Front-most cutting edge 44 comprises a width that is substantially equal to width W of the chisel blade 10. In a non-limiting embodiment, front-most cutting edge 44 is about 1.0±0.1 inches wide. In one embodiment, back edge 46 may be formed at an angle $\alpha$ relative to front-most cutting edge 44. More specifically, back edge 46 may be formed at an angle $\alpha$ relative to an axis C-C that is perpendicular to longitudinal axis A-A and provided along front-most cutting edge 44 of front beveled cutting edge portion 24. In an embodiment, back edge 46 is formed at an angle $\alpha$ of about 10 degrees to about 20 degrees relative to axis C-C or front cutting edge 44. In an embodiment, the angle $\alpha$ is about 17±2 degrees relative to axis C-C or front cutting edge 44.

Additionally, a side view of the blade as shown in FIG. 4 shows that at least angled surface 25 of front beveled cutting edge portion 24 is formed at an angle $\beta$ relative to plane P defined by bottom surface 32. In an embodiment, the angle $\beta$ at which angled surface 25 is formed relative to plane P is about 20 degrees to about 30 degrees. In another embodiment, the angle $\beta$ is about 25±2 degrees relative to plane P.

In an embodiment, a length or distance L7 from front-most cutting edge 44 to back edge 46 is about 0.2 inches to 0.9 inches. In an embodiment, distance L7 is about 0.3 inches to 0.7 inches. In an embodiment, a distance L7 from front-most cutting edge 44 to back edge 46 is about 0.5±0.1 inches.

First elongate side 20 of the main body portion 14 comprises beveled side cutting edge portion 26. Beveled side cutting edge portion 26 may be used to chip, chop, chisel, or cut material. More specifically, as will become further evident, beveled side cutting edge portion 26 may be used to chisel material at a lateral or side angle relative to the longitudinal axis A-A of the blade 10, such as by striking an opposite striking surface 28 of blade 10.

Beveled side cutting edge portion 26 may optionally be provided substantially along an entire length of the first elongate side 20 of chisel blade 10. A top view of the chisel blade 10, as shown in FIG. 3, shows that beveled side cutting edge portion 26 comprises a working side cutting edge 52 and a back edge 54. An angled surface 27 extends from back edge 54 to working side cutting edge 52 of beveled side cutting edge portion 26. The angled surface 27 (which is the surface that can be sharpened to increase the sharpness of the side 20) commences at its back edge 54, which may be contiguous with (and defines a side edge of) the top surface 30, and slopes downwardly toward the bottom surface 32 as it extends in a lateral direction towards the working side edge 52. In one embodiment, angled surface 27 intersects and forms an angle with top surface 30 of the main body portion 14. In one embodiment, the side cutting edge portion 26 comprises a double bevel.

In a non-limiting embodiment, angled surface 27 may extend substantially along an entire length of first elongate side 20 of main body portion 14. In an embodiment, working side cutting edge 52 comprises a length between about 4.0 to 5.0 inches long. In one embodiment, back edge 54 may be formed at an angle σ relative to side cutting edge 52. More specifically, back edge 54 may be formed at an angle σ relative to an axis B that is parallel to longitudinal axis A-A and provided along working side cutting edge 52 of beveled side cutting edge portion 26. In an embodiment, the angle σ at which back edge 54 is formed relative to axis B or side cutting edge 52 is about 1 degree to about 5 degrees. In another embodiment, back edge 54 is formed at an angle σ of about 2±1 degrees relative to axis B or side cutting edge 52.

The angled surface 25 of front beveled cutting edge portion 24 may, in one embodiment, meet and/or intersect with angled surface 27 of beveled side cutting edge portion 26. At a juncture of the sharpened edges, an edge 31 may be formed.

Striking surface 28 is provided on the opposite, second elongate side 22 of the main body portion 14 of chisel blade 10. Striking surface 28 comprises a surface for impact with a tool (e.g., hammer, mallet) so that beveled side cutting edge portion 26 can be used to chisel materials at an angle with respect to central longitudinal axis A-A of the chisel.

Striking surface 28 comprises a thickness that is larger than a thickness of beveled side cutting edge portion 26. This allows for a larger surface area in which to strike chisel blade 10 on second elongate side 22 with a tool (e.g., so that beveled side cutting edge portion 26 can be used in a chopping operation). Accordingly, main body portion 14 narrows in thickness as it extends in a lateral direction from the striking surface 28 towards the beveled side cutting edge portion 26. In an embodiment, the variation in thickness of the main body portion 14 is formed by providing top surface 30 of the blade 10 at an angle with respect to bottom surface 32.

Figure 6:
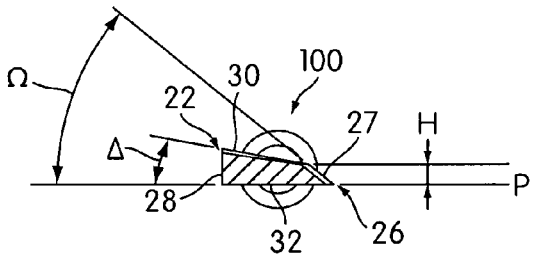
FIG. 6 shows a cross-section view taken through the line 6-6 of FIG. 4 (looking towards the handle portion) in accordance with an embodiment, illustrating a non-constant cross-sectional shape.

FIG. 6 shows a cross-sectional view of blade 10 looking towards the handle portion 12. A cross section, as indicated by line 6-6 in FIG. 4, is taken along the width of the blade 10 in a lateral direction that is perpendicular to a longitudinal direction of the blade, i.e., perpendicular to longitudinal axis A-A. The thickness of cross-sections of the elongate main body portion 14 taken in a lateral direction are non-constant, i.e., a thickness at a first width location is different than a thickness at a second width location. More specifically, in the illustrated embodiment, top surface 30 of elongate body portion 14 is provided with a downward slope (optionally substantially along the entire length of the blade 10) in a lateral direction from the striking surface side (first elongate side 22) towards the angled cutting portion side (second elongate side 20), thus narrowing the thickness of the main body portion 14 in the lateral direction (from the strike surface 28 to the beveled side cutting edge portion 26). When viewed along longitudinal axis A-A, as shown in FIG. 6, top surface 30 is formed at an angle Δ relative to plane P provided adjacent bottom surface 32 (to form the downward slope). In an embodiment, the downward slope of top surface 30 is formed at an angle Δ of about 4 degrees to about 12 degrees relative to plane P (i.e., with respect to a plane that is defined by a bottom surface 32 of the main body portion 14). In one embodiment, angle Δ is about 7 degrees to about 9 degrees relative to plane P. In another embodiment, angle Δ is about 8 ±2 degrees relative to plane P.

FIG. 6 also shows that angled surface 27 of beveled side cutting edge portion 26 is formed at an angle Ω relative to plane P defined by bottom surface 32. In an embodiment, angled surface 27 is formed at an angle Ω of about 35 degrees to about 45 degrees relative to plane P. In another embodiment, the sharpened portion of surface 27 is formed at an angle Ω of about 40±2 degrees.

Further to varying the thickness of the main body 14 in a lateral direction (i.e., via the top surface 30 comprises a downward slope from second elongate side 22 to first elongate side 20), in accordance with an embodiment, a side view of the blade 10 as shown in FIG. 4 shows that a thickness of the blade 10 may also vary along at the longitudinal axis A-A. That is, main body portion 14 narrows in thickness as it extends in a forward direction from a relatively rearward portion thereof towards the front beveled cutting edge portion 24. The thickness of cross-sections of the elongate main body portion 14 taken in a longitudinal direction are non-constant, i.e., a thickness at a first (rearward) longitudinal location is different (thicker) than thickness at a second (forward) longitudinal location. For example, in an embodiment, top surface 30 may also be configured to slope in a forward direction and downwardly at an angle Θ from back portion 36 towards front beveled cutting edge portion 24 of front portion 34 relative to plane P. In an embodiment, the forward slope of top surface 30 is at an angle Θ of about 4 degrees to about 12 degrees, with respect to plane P that is parallel to central longitudinal axis A-A (i.e., with respect to a plane P that is defined by a bottom surface 32 of the main body portion 14). In an embodiment, the angle Θ of top surface 30 about 7 degrees to about 9 degrees with respect to plane P. In another embodiment, the top surface 30 is at an angle Θ of about 8 ±2 degrees with respect to plane P.

Accordingly, both the striking surface 28 and beveled side cutting edge portion 26 may have variable thicknesses in a longitudinal direction. Striking surface 28 may comprise a first thickness T adjacent back portion 36. Because the top surface 30 is configured to slope downwardly from relatively rearward portion 36 towards front portion 34 of blade 10, striking surface 28 may comprise a second thickness T2 at front portion 34, where T>T2. Also, beveled side cutting edge portion 26 may comprise a first thickness T3 adjacent back portion 36 of blade 10 and a second thickness T4 at front portion 34, where T3>T4. The thickness T, T2, T3, and T4 may vary based on both angles Δ and Θ at which top portion 30 slopes.

In an embodiment, beveled side cutting edge 26 may optionally include one or more teeth 38 along its length for cutting or sawing into materials. In the illustrated embodiment, four (4) teeth are shown. However, any number of teeth (including none) may be provided on beveled side cutting edge portion 26. The teeth 38 may be formed at any number of locations and in any grouping along the length of the chisel blade 10.

Figure 7:
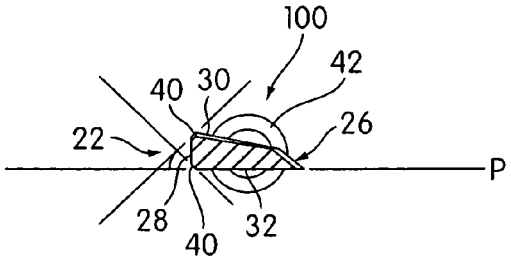
FIG. 7 shows a cross-section view similar to that of FIG. 6 pointing to corner chamfers of a chisel blade, in accordance with an embodiment.

FIG. 7 shows a cross-section view of a section of FIG. 4 (looking towards the handle portion 12) illustrating a cross-sectional shape of a chisel blade 10 as well as corner chamfers 40 on chisel blade 10, in accordance with another embodiment. In this embodiment, rather than form a straight edge where striking surface 28 and top surface 30 meet, a chamfer 40 is provided. Additionally and/or alternatively, a chamfer 40 may be provided where striking surface 28 and bottom surface 32 meet. The chamfer 40 may have a chamfer angle with respect to plane P adjacent bottom surface 32. In an embodiment, the chamfer angle may be between about 40 degrees and about 50 degrees. In another embodiment, the chamfer angle may be about 45±2 degrees. In another embodiment, the corner chamfer 40 may be replaced by a radiused or rounded corner.

Because the chisel blade 10 is configured to have a top surface 30 that slopes downwardly at an angle in both a lateral direction (e.g., from striking surface 28 towards beveled side cutting edge portion 26) and in a longitudinal direction (e.g., from back portion 36 towards front portion 34), the chisel blade 10 may comprise a number of thicknesses along its length and width. The noted dimensions (lengths, angles, diameters, etc.) as described herein are not meant to be limiting.

When striking surface 28 receives an impact (e.g., from a hammer), force is transmitted through the main body portion 14 to at least the beveled side cutting edge portion 26. Additionally, front beveled cutting edge portion 24 may be used for chiseling materials. That is, when the end cap 18 of handle 12 receives an impact (e.g., from a hammer), force is transmitted through the main body portion 14 to at least the front beveled cutting edge portion 24. Thus, both striking surface 28 and end cap 18 can be considered to be driving engagement surfaces for using beveled side cutting edge portion 26 and front beveled cutting edge portion 24 for chiseling or cutting.

The materials, hardnesses, and methods of manufacturing chisel blade 10 should not be limited. In one embodiment, main body portion 14 is made of one or more materials. An exemplary embodiment would include body portion 14 made of carbon steel having a Rockwell Hardness (HRC) in the range of 35 to 60 HRC.

Additionally, it should be noted that any number of processes may be used on chisel blade 10. For example, in an embodiment, the chisel blade 10 may be heat treated. Moreover, chisel blade 10 may be formed such that particular parts of the blade are stronger and/or resistant to damage than others. In one embodiment, the entire chisel blade 10 is heat treated and bulk hardened to so that a majority of the main body portion 14 has a hardness of about 38 to about 44 HRC. In a non-limiting embodiment, at least a majority of front portion 34 (e.g., front beveled cutting edge portion 24, or chisel tip) is then locally hardened to a hardness of about 55 to about 58 HRC. In another embodiment, a majority of the main body portion 14 of the chisel blade 10 is hardened to a hardness of about 55 to about 58 HRC. In another non-limiting embodiment, a majority of striking surface edge 28 is then locally heat tempered to a hardness of about 38 to about 44 HRC. The chisel blade 10 may also comprise a combination of hardnesses. For example, in accordance with some embodiments, two thirds of the entire chisel blade 10 is hardened to a hardness of about 55 to about 58 HRC, and the striking surface edge 28 is locally tempered to a hardness of about 38 to about 44 HRC.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A chisel comprising:

a handle;

a back end of the handle configured to be struck by a striking instrument;

an elongated blade joined with the handle, the blade including a main body portion, a front beveled cutting edge portion at a forward end thereof, a beveled side cutting edge portion along a first longitudinal side of the blade, and a strike surface along a second longitudinal side of the blade opposite the first longitudinal side, the strike surface configured to be struck by an impact tool and having a hardness of about 38 HRC to about 44 HRC;

wherein the main body portion narrows in thickness as it extends in a forward direction from a relatively rearward portion thereof towards the front beveled cutting edge portion, and that narrows in thickness as it extends in a lateral direction from the strike surface towards the beveled side cutting edge portion, wherein the beveled side cutting edge portion comprises a surface that forms an angle with a surface of the main body portion, wherein the front beveled cutting edge portion comprises a surface that intersects and forms an angle with the surface of the main body portion, and wherein the front beveled cutting edge portion terminates at a front cutting edge, and wherein the front beveled cutting portion further comprises a back edge formed at an angle relative to its front cutting edge.

2. The chisel according to claim 1, wherein the surface of the beveled side cutting edge portion intersects with the surface of the main body portion.

3. The chisel according to claim 1, wherein the beveled side cutting edge portion terminates at a side cutting edge.

4. The chisel according to claim 3, wherein the beveled side cutting edge portion further comprises a back edge formed at an angle relative to its side cutting edge.

5. The chisel according to claim 4, wherein the angle of the back edge is between about 1 degrees to about 5 degrees relative to the side cutting edge.

6. The chisel according to claim 1, wherein the beveled side cutting edge portion further comprises teeth.

7. The chisel according o claim 1, wherein the surface of the front beveled cutting edge portion is formed at an angle relative to a plane defined by a bottom surface of the elongated blade.

8. The chisel according to claim 7, wherein the angle is about 20 degrees to about 30 degrees relative to the plane.

9. The chisel according to claim 7, wherein the angle is about 25±2 degrees relative to the plane.

10. The chisel according to claim 1, wherein the surface of the beveled side cutting edge portion is formed at an angle relative to a plane defined by a bottom surface of the elongated blade.

11. The chisel according to claim 10, wherein the angle is about 35 degrees to about 45 degrees relative to the plane.

12. The chisel according to claim 11, wherein the angle is about 40±2 degrees relative to the plane.

13. The chisel according to claim 1, wherein a majority of the main body portion of the blade has a hardness of about 38 HRC to about 44 HRC, and wherein a majority of the front beveled cutting edge portion has a hardness of about 55 HRC to about 58 HRC.

14. The chisel according to claim 1, wherein a majority of the main body portion of the blade has a hardness of about 55 HRC to about 58 HRC.

15. The chisel according to claim 1, wherein the angle of the back edge is about 10 degrees to about 20 degrees relative to the front cutting edge.

16. The chisel according to claim 1, wherein a distance from the front cutting edge to the back edge of the front beveled cutting portion is between about 0.2 inches to 0.9 inches.

17. The chisel according to claim 1, wherein the main body portion comprises a top surface that slopes in a lateral direction and downwardly from the strike surface towards the beveled side cutting edge portion at an angle of about 4 degrees to about 12 degrees with respect to a plane that is defined by a bottom surface of the main body portion.

18. The chisel according to claim 17, wherein the angle of the top surface in the lateral direction with respect to the plane is about 7 degrees to about 9 degrees.

19. The chisel according to claim 1, wherein the main body portion comprises a top surface that slopes in the forward direction and downwardly from the relatively rearward portion thereof towards the front beveled cutting portion at an angle of about 4 degrees to about 12 degrees with respect to a plane that is defined by a bottom surface of the main body portion.

20. The chisel according to claim 19, wherein the angle of the top surface in the forward direction with respect to the plane is about 7 degrees to about 9 degrees.

21. A chisel comprising:

a handle;

a back end of the handle configured to be struck by a striking instrument;

an elongated blade joined with the handle, the blade including a main body portion, a front beveled cutting edge portion at a forward end thereof, a beveled side cutting edge portion along a first longitudinal side of the blade, and a strike surface along a second longitudinal side of the blade opposite the first longitudinal side;

wherein the main body portion narrows in thickness as it extends in a forward direction from a relatively rearward portion thereof towards the front beveled cutting edge portion, and that narrows in thickness as it extends in a lateral direction from the strike surface towards the beveled side cutting edge portion, wherein the beveled side cutting edge portion comprises a surface that forms an angle with a surface of the main body portion, wherein the front beveled cutting edge portion comprises a surface that intersects and forms an angle with the surface of the main body portion, and wherein the front beveled cutting edge portion terminates at a front cutting edge and comprises a back edge formed at an angle relative to its front cutting edge.

22. The chisel according to claim 21, wherein the surface of the beveled side cutting edge portion intersects with the surface of the main body portion.

23. The chisel according to claim 21, wherein the beveled side cutting edge portion further comprises teeth.

24. The chisel according to claim 21, wherein the front beveled cutting edge portion comprises a surface that intersects with the surface of the main body portion, and wherein the front beveled cutting edge portion terminates at a front cutting edge.

25. The chisel according to claim 24, wherein the surface of the front beveled cutting edge portion is formed at an angle relative to a plane defined by a bottom surface of the elongated blade.

26. The chisel according to claim 25, wherein the angle formed by the surface of the front beveled cutting edge portion relative to the plane defined by the bottom surface of the elongated blade is about 20 degrees to about 30 degrees relative to the plane.

27. The chisel according to claim 25, wherein the angle formed by the surface of the front beveled cutting edge portion relative to the plane defined by the bottom surface of the elongated blade is about 25±2 degrees relative to the plane.

28. The chisel according to claim 21, wherein the surface of the beveled side cutting edge portion is formed at an angle relative to a plane defined by a bottom surface of the elongated blade.

29. The chisel according to claim 28, wherein the angle formed by the surface of the beveled side cutting edge portion relative to the plane defined by the bottom surface of the elongated blade is about 35 degrees to about 45 degrees relative to the plane.

30. The chisel according to claim 29, wherein the angle formed by the surface of the beveled side cutting edge portion relative to the plane defined by the bottom surface of the elongated blade is about 40±2 degrees relative to the plane.

31. The chisel according to claim 21, wherein a majority of the main body portion of the blade has a hardness of about 38 HRC to about 44 HRC, and wherein a majority of the front beveled cutting edge portion has a hardness of about 55 HRC to about 58 HRC.

32. The chisel according to claim 21, wherein a majority of the main body portion of the blade has a hardness of about 55 HRC to about 58 HRC, and wherein a majority of the strike surface has a hardness of about 38 HRC to about 44 HRC.

33. The chisel according to claim 21, wherein the angle of the back edge is about 10 degrees to about 20 degrees relative to the front cutting edge.

34. The chisel according to claim 21, wherein a distance from the front cutting edge to the back edge of the front beveled cutting portion is between about 0.2 inches to 0.9 inches.

35. The chisel according to claim 21, wherein the main body portion comprises a top surface that slopes in a lateral direction and downwardly from the strike surface towards the beveled side cutting edge portion at an angle of about 4 degrees to about 12 degrees with respect to a plane that is defined by a bottom surface of the main body portion.

36. The chisel according to claim 35, wherein the angle of the top surface in the lateral direction with respect to the plane is about 7 degrees to about 9 degrees.

37. The chisel according to claim 21, wherein the main body portion comprises a top surface that slopes in the forward direction and downwardly from the relatively rearward portion thereof towards the front beveled cutting portion at an angle of about 4 degrees to about 12 degrees with respect to a plane that is defined by a bottom surface of the main body portion.

38. The chisel according to claim 37, wherein the angle of the top surface in the forward direction with respect to the plane is about 7 degrees to about 9 degrees.

39. A chisel comprising:

a handle;

a back end of the handle configured to be struck by a striking instrument;

an elongated blade joined with the handle, the blade including a main body portion, a front beveled cutting edge portion at a forward end thereof, a beveled side cutting edge portion along a first longitudinal side of the blade, and a strike surface along a second longitudinal side of the blade opposite the first longitudinal side;

wherein the main body portion narrows in thickness as it extends in a forward direction from a relatively rearward portion thereof towards the front beveled cutting edge portion, and that narrows in thickness as it extends in a lateral direction from the strike surface towards the beveled side cutting edge portion, wherein the beveled side cutting edge portion comprises a surface that forms an angle with a surface of the main body portion, wherein the beveled side cutting edge portion terminates at a side cutting edge, and wherein the beveled side cutting edge portion further comprises a back edge formed at an angle relative to its side cutting edge.

40. The chisel according to claim 39, wherein the angle of the back edge is between about 1 degrees to about 5 degrees relative to the side cutting edge.

41. The chisel according to claim 39, wherein the surface of the beveled side cutting edge portion intersects with the surface of the main body portion.

42. The chisel according to claim 39, wherein the beveled side cutting edge portion further comprises teeth.

43. The chisel according to claim 39, wherein the front beveled cutting edge portion comprises a surface that intersects with the surface of the main body portion, and wherein the front beveled cutting edge portion terminates at a front cutting edge.

44. The chisel according to claim 43, wherein the surface of the front beveled cutting edge portion is formed at an angle relative to a plane defined by a bottom surface of the elongated blade.

45. The chisel according to claim 44, wherein the angle formed by the surface of the front beveled cutting edge portion relative to the plane defined by the bottom surface of the elongated blade is about 20 degrees to about 30 degrees relative to the plane.

46. The chisel according to claim 44, wherein the angle formed by the surface of the front beveled cutting edge portion relative to the plane defined by the bottom surface of the elongated blade is about 25±2 degrees relative to the plane.

47. The chisel according to claim 43, wherein a distance from the front cutting edge to the back edge of the front beveled cutting portion is between about 0.2 inches to 0.9 inches.

48. The chisel according to claim 39, wherein the surface of the beveled side cutting edge portion is formed at an angle relative to a plane defined by a bottom surface of the elongated blade.

49. The chisel according to claim 48, wherein the angle formed by the surface of the beveled side cutting edge portion relative to the plane defined by the bottom surface of the elongated blade is about 35 degrees to about 45 degrees relative to the plane.

50. The chisel according to claim 49, wherein the angle formed by the surface of the beveled side cutting edge portion relative to the plane defined by the bottom surface of the elongated blade is about 40±2 degrees relative to the plane.

51. The chisel according to claim 39, wherein a majority of the main body portion of the blade has a hardness of about 38 HRC to about 44 HRC, and wherein a majority of the front beveled cutting edge portion has a hardness of about 55 HRC to about 58 HRC.

52. The chisel according to claim 39, wherein a majority of the main body portion of the blade has a hardness of about 55 HRC to about 58 HRC, and wherein a majority of the strike surface has a hardness of about 38 HRC to about 44 HRC.

53. The chisel according to claim 39, wherein the angle of the back edge is about 10 degrees to about 20 degrees relative to the front cutting edge.

54. The chisel according to claim 39, wherein the main body portion comprises a top surface that slopes in a lateral direction and downwardly from the strike surface towards the beveled side cutting edge portion at an angle of about 4 degrees to about 12 degrees with respect to a plane that is defined by a bottom surface of the main body portion.

55. The chisel according to claim 54, wherein the angle of the top surface in the lateral direction with respect to the plane is about 7 degrees to about 9 degrees.

56. The chisel according to claim 39, wherein the main body portion comprises a top surface that slopes in the forward direction and downwardly from the relatively rearward portion thereof towards the front beveled cutting portion at an angle of about 4 degrees to about 12 degrees with respect to a plane that is defined by a bottom surface of the main body portion.

57. The chisel according to claim 56, wherein the angle of the top surface in the forward direction with respect to the plane is about 7 degrees to about 9 degrees.

* * * * *